US005720396A

United States Patent [19]

Wegscheid et al.

[11] Patent Number: 5,720,396

[45] Date of Patent: Feb. 24, 1998

[54] DISPLAY RACK FOR GREETING CARDS AND THE LIKE

[76] Inventors: Ervin J. Wegscheid; Stephen A. Wegscheid, both of Rural Rte. 2, Box 212, Dent, Minn. 56528

[21] Appl. No.: 630,007

[22] Filed: Apr. 8, 1996

[51] Int. Cl.[6] ..... A47F 5/00

[52] U.S. Cl. ..... 211/55

[58] Field of Search ..... 211/55, 56, 128

[56] References Cited

U.S. PATENT DOCUMENTS 188,519 3/1877 Lamoree ..... 211/55

4,613,047 9/1986 Bushyhead et al. ..... 211/55

4,938,366 7/1990 Carroll ..... 211/55

5,009,335 4/1991 Jonker ..... 211/55

*Primary Examiner*—Alvin C. Chin-Shue

*Assistant Examiner*—Sarah L. Purol

[57] ABSTRACT

This is a display rack assembly particularly designed for displaying greeting cards for inspection by prospective customers and which is constructed of a plurality of elongated sections each of which includes a front retaining flange at the forward edge portion of a supporting shelf and which has an upwardly extending back panel with a connecting hook at the top thereof for receiving the front upstanding retaining flange 13 to provide a connection between two adjacent sections.

3 Claims, 1 Drawing Sheet

DISPLAY RACK FOR GREETING CARDS AND THE LIKE

BACKGROUND OF THE INVENTION

Large display racks are required for displaying greeting cards in stores for consumer inspection and choice. These display racks are arranged in multiple tiers within a pair of end panels. It has been a problem to provide a joint between adjacent rack sections that will provide the required stability for displaying different size cards in multiple tiers so that substantial portions of each card are presented for view by the shopper.

SUMMARY OF THE INVENTION

The display rack construction embodying this invention provides a joint structure between adjacent tiers which includes not only a supporting edge to edge contact with the top of a connecting hook formed at the upper edge of the back panel of each rack section, but also provides additional stabilizing contact between the lower edge of the hook and the front flange of the next rack section so that a substantially rigid multiple tier rack construction is provided. The lower supporting shelf of each tier is sloped toward the front so that the cards displayed are maintained at the front edge of the shelf to provide optimum presentation of the cards. It is important in the displaying of cards that a substantially rigid multiple tier rack is provided which will resist movement by the customers as they remove cards for inspection and subsequently replace the rejected cards back in the rack slots.

DESCRIPTION OF THE INVENTION

Figure 1:
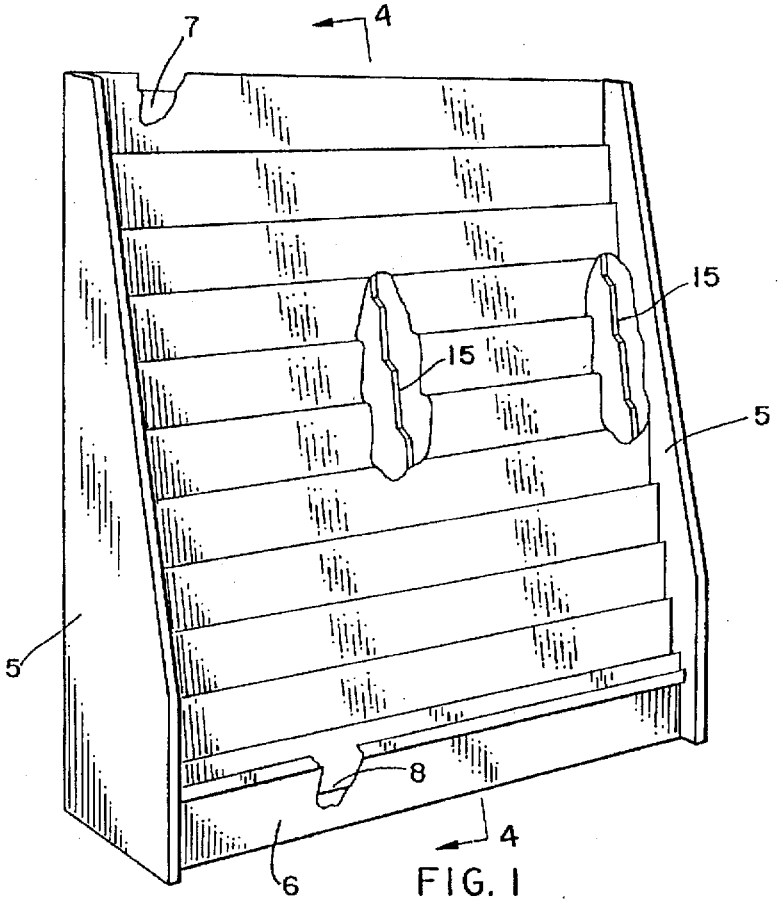
FIG. 1 is a perspective view showing an assembled card display rack with portions broken away.

FIG. 1 illustrates a display rack assembly which includes a pair of side panels 5 connected by a rigid bottom member 6 and a rigid back member 7. The rack assembly includes a plurality of interconnected display sections which are mounted on a bottom supporting shelf 8 and extend between the side panels 5.

Figure 2:
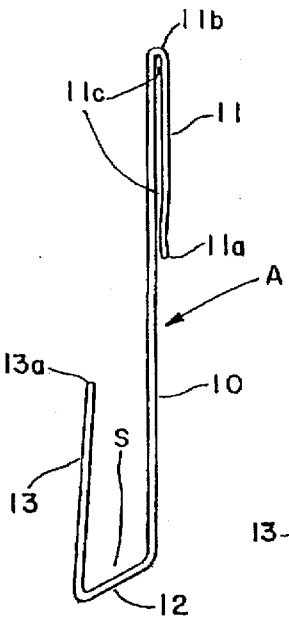
FIG. 2 is an end elevation of a single rack section.
Figure 3:
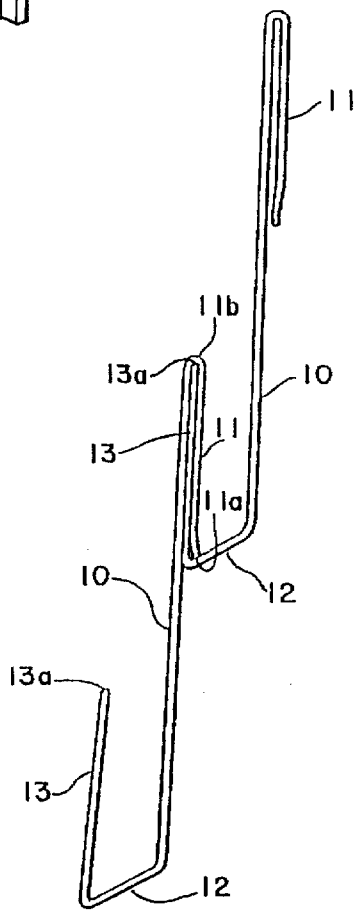
FIG. 3 is an end view of a pair of adjacent rack sections in assembled relationship.

A typical display rack section A is illustrated in FIGS. 2 and 3 and each section A includes an elongated back panel 10 having a depending connecting hook 11 integrally formed along the upper edge thereof and extending downwardly behind the upper marginal edge of the back panel 10. The hook 11 has a flared lower edge 11*a*, an upper apex 11*b* and defines a slot 11*c* therein. A bottom shelf 12 is formed at the bottom of the back panel 10 and slopes downwardly toward the front thereof. An upstanding front retaining flange 13 is formed along the front edge of the sloping bottom shelf 12 of each section. A card receiving opening S is formed between the front flange 13 and the rearwardly opposed lower portion of the back panel 10.

The rack sections A are assembled by inserting the front retaining flange 13 of the adjacent upper section into the slot 11*c* formed within the hook 11.

Figure 4:
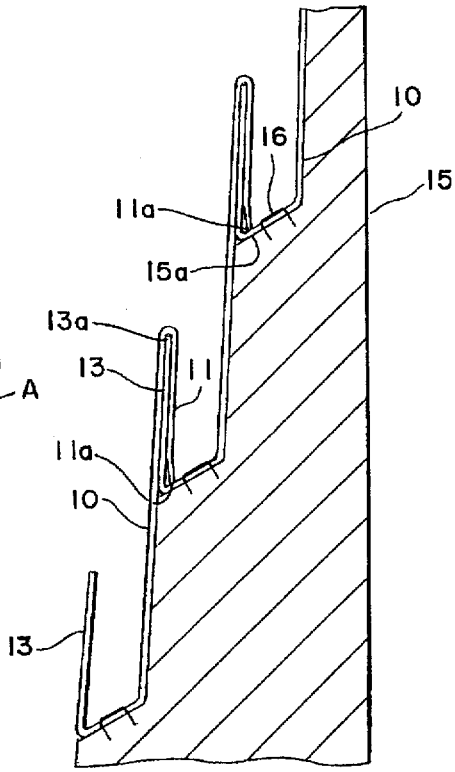
FIG. 4 is a sectional view taken substantially along the line of 4—4 of FIG. 1.

The lower edge 11*a* of the hook element 11 contacts the front edge portion of the sloping bottom shelf 12 as best shown in FIGS. 3 and 4 to provide a highly stable joint between the two joined together sections. The lower edge portion 11*a* of hook 11 is flared outwardly to facilitate entrance of the upper edge 13*a* of the retaining flange 13 into the slot 11*c* during assembly and the upper edge 13*a* of the retaining flange 13 engages the inside of the apex 11*b* of the connecting hook 11 when assembled. These two contact edges 11*a* and 13*a* stabilize the joint between adjacent sections and provide a positive connection joint therebetween. A suitable rigid supporting frame may be provided for the assembled rack sections A. This frame includes three spaced apart stepped rigid frame members 15 having sloping steps 15*a* to which the rack sections A are securely attached as by attachment staples 16 driven through the sloping shelf portions 12 into the steps 15*a* as shown.

It will be seen that we have provided an easily assembled yet rigid rack assembly for displaying greeting cards and the like.

What is claimed is:

1. A display rack for greeting cards and the like comprising a plurality of sections adapted to be interconnected into a substantially rigid unit providing a plurality of shelf areas having a retaining flange along the outer edges thereof to retain and display cards therein, each section including a back panel, an upper hook element formed at the top of the back panel, a shelf formed at the bottom of the back panel and extending forwardly therefrom to receive cards to be displayed, an upstanding retaining flange connected at the front edge of the shelf and extending upwardly therefrom substantially less than the height of the cards to be displayed, wherein each shelf slopes downwardly and outwardly from the lower edge of the back panel to the lower edge of the retaining flange to maintain the cards being displayed at the front marginal edge portion of the shelf.

and a plurality of spaced apart rigid frame members having sloping supporting steps to engage the respective shelves of the assembled rack sections, and attachment staples driven through the shelves into the underlying step portions of the frame members.

2. The Structure set forth in claim 1 wherein each on hook element includes a flared lower edge portion formed at the bottom thereof to guide the upper edge portion of the back panel into the opening defined by the connecting hook.

3. A display rack for greeting cards and the like comprising a plurality of sections adapted to be interconnected into a substantially rigid unit providing a plurality of shelf areas having a retaining flange along the outer edges thereof to retain and display cards therein, each section including a back panel, an upper hook element formed at the top of the back panel.

a shelf formed, at the bottom of the back panel and extending forwardly therefrom to receive cards to be displayed.

an upstanding retaining flange connected at the front edge of the shelf and extending upwardly therefrom substantially less than the height of the cards to be displayed, wherein the upper edge of the front retaining flange of the upper section engages the inside surface at the top of said hook element and the lower rear free edge of the hook element engages the surface of the front edge portion of the shelf.

* * * * *